US007784257B2

(12) United States Patent
Williams et al.

(10) Patent No.: US 7,784,257 B2
(45) Date of Patent: Aug. 31, 2010

(54) DEBRIS COLLECTION DEVICE

(75) Inventors: Ronnie D. Williams, 332 Kudzu Rd., Neeses, SC (US) 29107; Robert Williams, North, SC (US); Michael Ray Cook, North, SC (US)

(73) Assignee: Ronnie D. Williams, Neeses, SC (US)

( * ) Notice: Subject to any disclaimer, the term of this patent is extended or adjusted under 35 U.S.C. 154(b) by 0 days.

(21) Appl. No.: 12/273,856

(22) Filed: Nov. 19, 2008

(65) Prior Publication Data

US 2009/0126331 A1 May 21, 2009

Related U.S. Application Data

(60) Provisional application No. 60/988,884, filed on Nov. 19, 2007.

(51) Int. Cl.
*A01D 7/00* (2006.01)

(52) U.S. Cl. ..... 56/400.08; 172/378

(58) Field of Classification Search ..... 172/21, 172/22, 25, 378; 56/400.01–400.21; 294/61, 294/55.5, 19.1, 50.5–50.7
See application file for complete search history.

(56) References Cited

U.S. PATENT DOCUMENTS

| | | | | | |
|---|---|---|---|---|---|
| 1,965,177 | A * | 7/1934 | Finkl | 172/21 |
| 2,747,528 | A * | 5/1956 | Hunkins | 111/92 |
| 3,168,150 | A * | 2/1965 | Kappler | 172/371 |
| 3,180,427 | A * | 4/1965 | Leeper, Jr. | 172/21 |
| 3,633,958 | A * | 1/1972 | Mesrobian | 294/61 |
| 4,081,192 | A * | 3/1978 | Jones | 294/61 |
| 4,791,995 | A * | 12/1988 | Hochlan, Jr. | 172/21 |
| 5,193,871 | A * | 3/1993 | Williams | 294/61 |
| 5,370,433 | A * | 12/1994 | Yost | 294/50.5 |
| 5,642,911 | A * | 7/1997 | Gatch | 294/61 |
| 6,016,876 | A * | 1/2000 | Rountree et al. | 172/378 |
| 6,634,163 | B2 * | 10/2003 | Kill | 56/400.08 |

* cited by examiner

*Primary Examiner*—Robert E Pezzuto
(74) *Attorney, Agent, or Firm*—Calhoun Thomas, III; Samuel Alexander Long, Jr.

(57) ABSTRACT

The invention is a device for the safe and efficient collection of debris displaced across a collection field. Utilizing a plurality of spikes which pierce and penetrate articles of debris, the invention contemplates the accumulation of articles of debris on the spikes. When the device has become loaded with debris, the device self ejects the debris using a compression spring force trigger mechanism.

4 Claims, 5 Drawing Sheets

DEBRIS COLLECTION DEVICE

RELATED APPLICATIONS

This application claims benefit of earlier filed U.S. Provisional Application having Ser. No. 60/988,884.

FEDERALLY SPONSORED RESEARCH OR DEVELOPMENT

Not applicable.

REFERENCED OR INCORPORATED MATERIAL

Not applicable.

FIELD OF THE INVENTION

The present invention relates to the field of debris collection and more specifically to a device for the efficient collection of debris. Debris, as used herein, is a term describing articles displaced in an environment. Typically it is desirable to collect such debris in order to dispose of it though the debris may be equally wanted or unwanted debris. For example, the debris may be unwanted litter along a highway or it may be fallen pine cones in a homeowner's yard. In any such case, the present invention may be utilized in collecting the debris for whatever purposes the collector may decide, though typically, this intention would be disposal of said debris.

SUMMARY OF THE INVENTION

The present invention is a device for the collection of debris. The invention is designed to be utilized primarily by a single person though it is also envisioned that teams of human debris collectors may be employed towards a given debris collection task. In this way, a collection team may use multiple copies of the device to collect debris distributed across a large field.

Designed to be held by one hand, the invention features a handle linearly displaced from sharp spikes which penetrate debris by downward pressure. This pressure is applied both by the weight of the device as well as a force projected by the human operator. As the operator approaches an article of debris, the operator punches down on the article, the spikes pierce and penetrate the article, and the article thus becomes lodged on the spike head of the device. The spike head is designed to hold many articles before becoming full.

When a collection field contains many articles of debris, the spike head may fill with debris many times during a collection. When full, the device is designed to be self emptying. The device features a trigger system whereby the operator actuates a trigger and the accumulated debris is thereby ejected from the spike head into appropriate receptacles or other appropriate locations.

Another important aspect of the device comes with respect to the spikes. The native resting position of the device is the ejected position which results with the spikes being shielded as opposed to being exposed in the loaded position. This may present a safety benefit by having the spikes be secured from imposing bodily injury when the device is in storage.

Yet another important aspect relates to the replacement life of the device. Each of the spikes used in the device may easily be replaced when an individual spike becomes worn after continual long term use. This may prevent the operator from having to replace the entire unit.

DETAILED DESCRIPTION

It is to be understood by a person having ordinary skill in the art that the present discussion is a description of exemplary embodiments only, and is not intended as limiting the broader aspects of the present invention. The following example is provided to further illustrate the invention and is not to be construed to unduly limit the scope of the invention.

Figure 1:
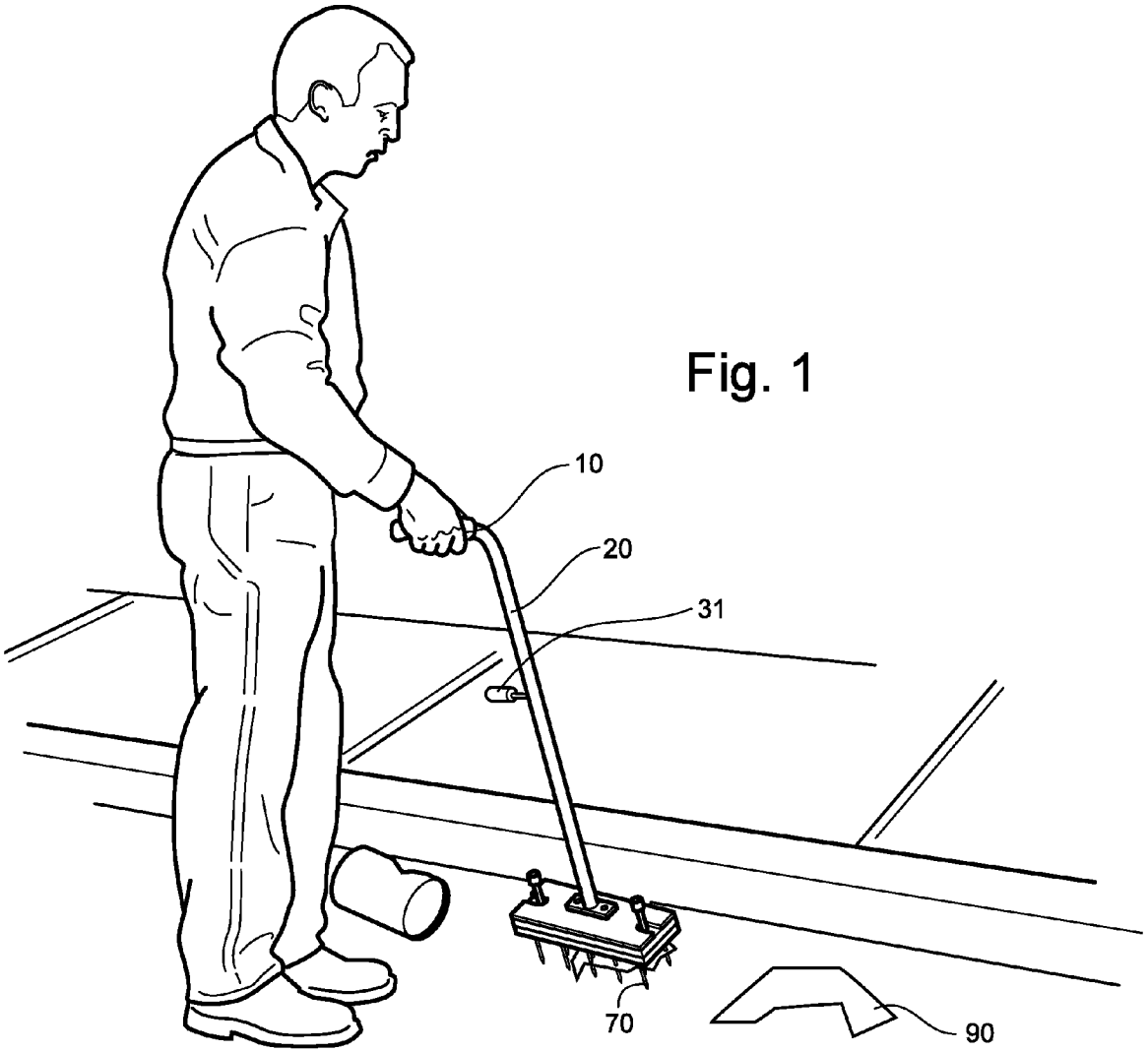
FIG. 1 is an environmental perspective view showing the device being used to collect debris.
Figure 2:
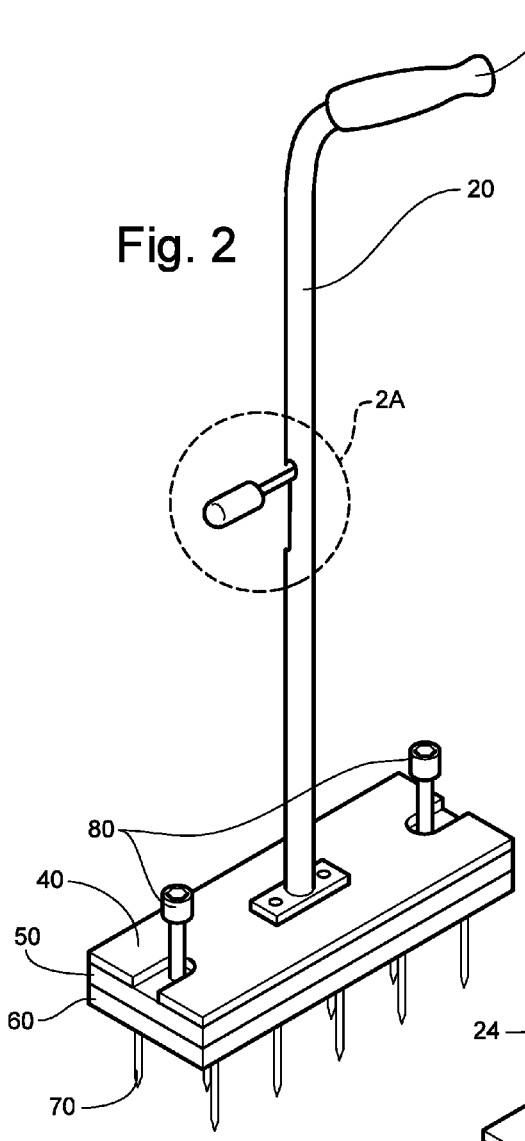
FIG. 2 is a perspective view of the device in the loaded position.
Figure 2A:
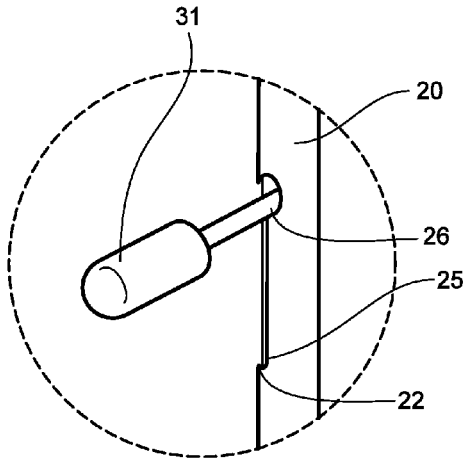
FIG. 2A is a perspective view of the device in the loaded position and highlighting the trigger in the loaded position.
Figure 2B:
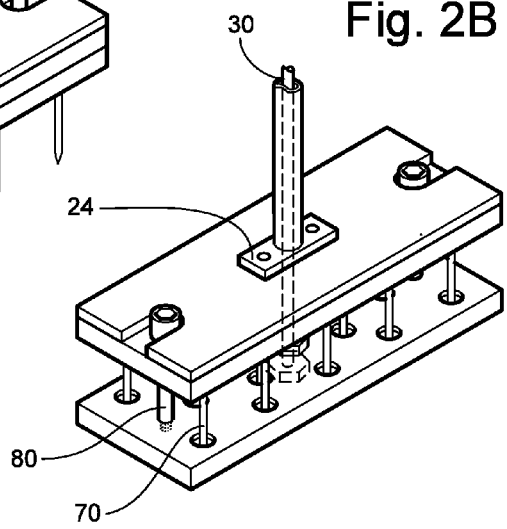
FIG. 2B is a perspective view of the device highlighting how the ejection plate operates with respect to the pusher rod.

The present invention is a device for the collection of debris. The invention comprises a handle (10), a shaft (20), an ejection trigger system, and a collection head. The handle (10) is ergonomically designed to afford the operator a power grip (see FIG. 1) on the device. In the preferred embodiment, the handle (10) is made of metal and is padded with plastic or foam.

Figure 3:
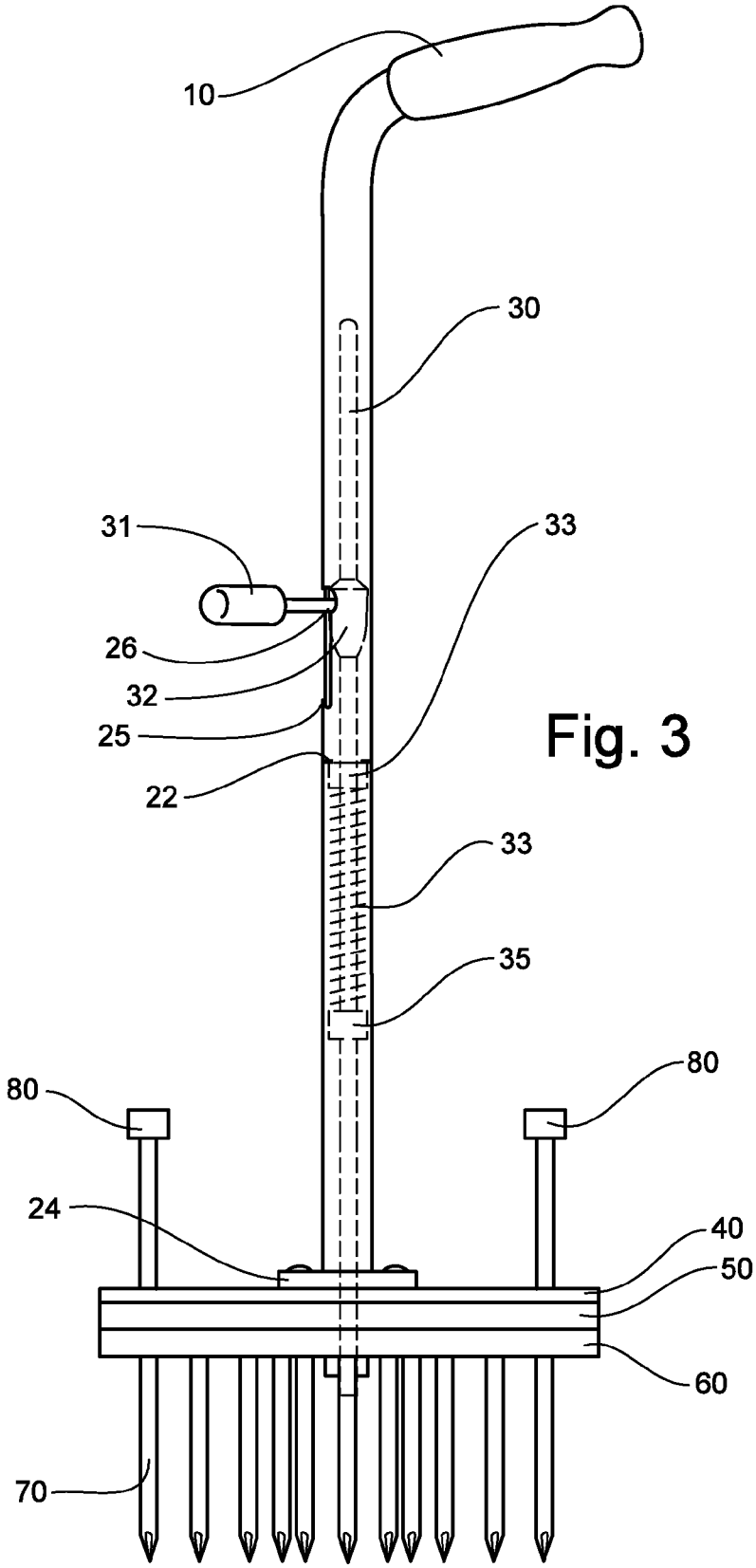
FIG. 3 is a side view of the device in the loaded position.

Like the handle (10), the shaft (20) is made of metal in the preferred embodiment and is attached to the handle (10) and to the collection head thereby spanning the vertical distance between the two. The shaft (20) is fixedly attached to the handle (10) at its upper end and removably attached to the collection head at its lower end. The shaft (20) is cylindrical in the preferred embodiment and is hollow such that the trigger system operates within the shaft (20). The shaft (20) further comprises an attachment plate (24) and a hook shaped trigger slot (21) through which the trigger operates from a loaded position (see FIG. 3) to an ejected position (see FIG. 4).

The attachment plate (24) is attached to the cylindrical portion of the shaft (20) at the lower end. The attachment plate (24) is the point of attachment of the shaft (20) to the collection head. In the preferred embodiment, the attachment plate (24) removably attaches to the collection head via metal screws (23).

The hook shaped trigger slot (21) of the shaft is a slot in the shape of an inverted fish hook which is cut into the cylindrical wall of the shaft (20). When at the top of the hook (26), the trigger is in the loaded position (see FIG. 3). When at the bottom of the hook (25), the trigger is in the ejected position (see FIG. 4).

The trigger system operates largely inside of the shaft (20) and is essential to the heart of the invention. The trigger operates from a loaded position (see FIG. 3) to an ejected position (see FIG. 4). In the loaded position, the collection spikes (70) are exposed and ready to collect debris. In the ejected position, the collection spikes (70) are safely covered and any debris previously collected has been ejected. Moving between the two positions, the trigger system utilizes a spring force acting in compression. When the trigger (31) is actuated by a human collector operating the device, the release of the spring force in compression moves the trigger (31) from the top of the hook (26) to the bottom (25) thereby ejecting the debris. To reset the device, the human collector operating the device pulls the trigger (31) back to the top of the hook (26) to the loaded position.

To achieve this trigger ejectment action, in the preferred embodiment, the trigger system further comprises a trigger handle (31), a trigger actuator (32), a pusher rod (30), a compression spring (34), a spring pusher (33), an indention point (22), and a spring stop (35). The trigger handle (31) is the means by which the human collector manipulates the trigger and moves it between the loaded position (see FIG. 3) and the ejected position (see FIG. 4). The trigger handle (31) is constrained in movement by the hook shaped trigger slot (21). The trigger handle (31) is removably attached to the trigger actuator (32) which is effectively the point of attachment between the trigger handle (31) and the pusher rod (30).

The pusher rod (30), located within the cylindrical cavity of the shaft (20), extends the length of the device from above the top of the hook shaped trigger slot (21) of the shaft (20) to the collection head. The spring pusher (33) is slidingly attached to the pusher rod (30) such that it may only move freely in the linear direction of the pusher rod (30). The spring pusher (33) is also constrained in linear movement by the indentation point (22) just below the extreme lower point of the hook shaped trigger slot (21) of the shaft (20). The indentation point (22) prevents the spring pusher (33) from moving above the lowest point of the hook shaped trigger slot (21) of the shaft.

Like the spring pusher (33), the compression spring (34) is slidingly attached to the pusher rod (30) and is free to move in the linear direction of the pusher rod (30). The compression spring (34) is, however, constrained by the spring pusher (33) at its upper point and by the spring stop (35) at its lower point. The spring stop (35) is much like the spring pusher (33) excepted it is fixedly attached to the pusher rod (35).

Thus, when manipulated to the loaded position, the trigger handle (31) is pulled up to the top of the hook shaped trigger slot (21) which, in turn, pulls the pusher rod (20) upward thereby also pulling the spring stop (35) upwards. As the spring stop (35) is pulled upwards the compression spring (34) moves upwards as does the spring pusher (33) which becomes pressed against the indentation point (22). Once the spring pusher (33) is pressed against the indentation point (22), the compression spring (34) begins to enter tighter compression as the pusher rod (30) and, thereby, the spring stop (35) continues being pulled upwards. This loading process continues until the trigger handle (31) has been pulled to the top of the hook shaped trigger slot (21) of the shaft (20) and is resting in the hook portion (at the top) of the hook shaped trigger slot (21). At that point when the trigger is resting in the loaded position, the spring pusher (33) is firmly pressed against the indentation point (22), the compression spring (34) is tightly compressed between the spring stop (35) and the spring pusher (33), and the pusher rod (30) has brought the collection head into a loaded position (see FIG. 3) where the collection spikes (70) are exposed and ready to be loaded with debris.

Figure 4:
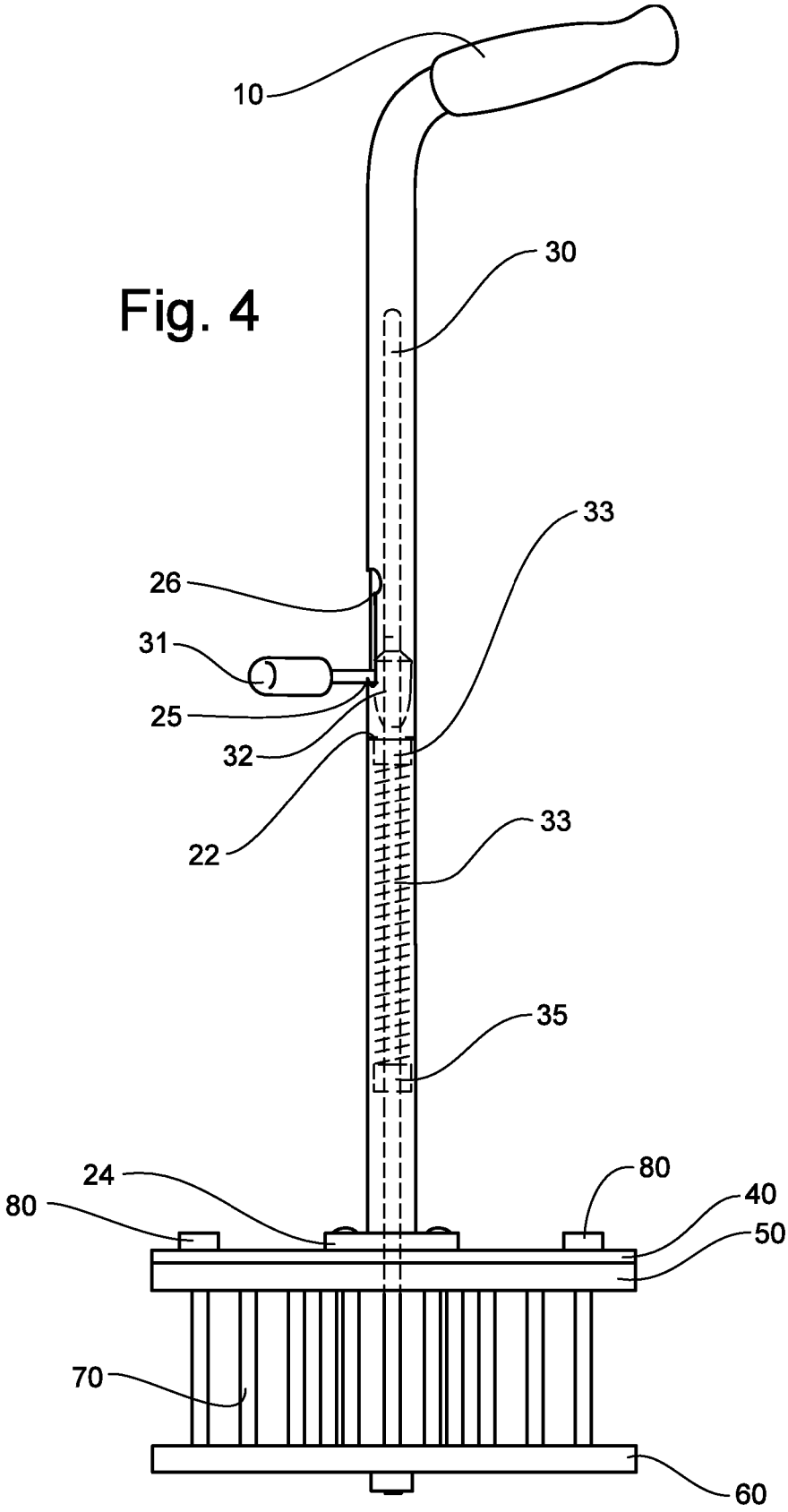
FIG. 4 is a side view of the device in the ejected position.
Figure 5:
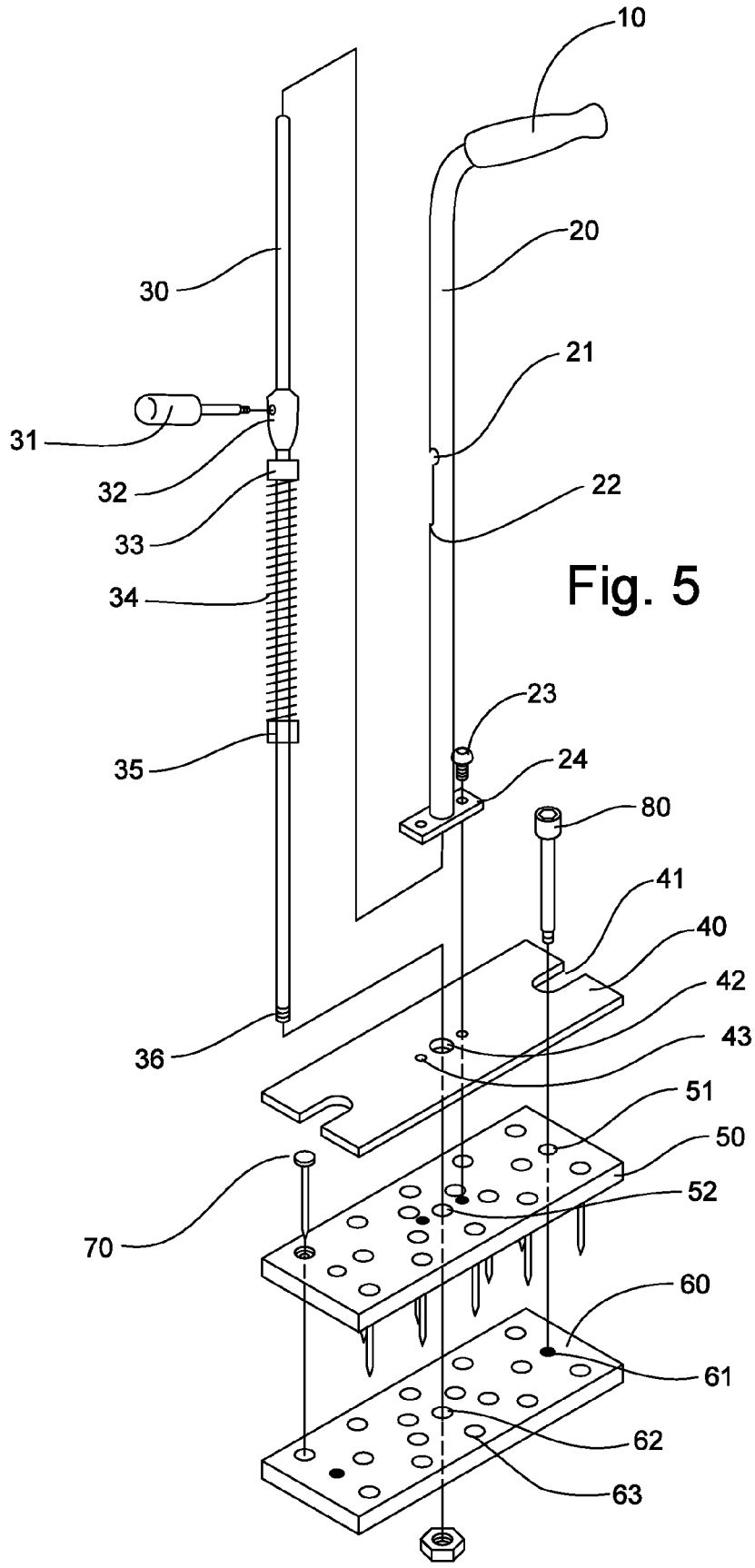
FIG. 5 is an exploded view of the device.

Accordingly, when the trigger handle (31) is moved over the hook portion of the hook shaped trigger slot (21) of the shaft (20), the compression spring (34) is released placing a downward force on the spring stop (35) and thereby the pusher rod (30) which causes the respective elements of the collection head (which are explained in greater detail below) to eject whatever debris has been collected by the collection spikes (70) and thereby come to rest in the ejected position (see FIG. 4).

As stated above, the collection head moves from a loaded position (see FIG. 3) to an ejected position (see FIG. 3) as articulated by the trigger system operating inside the shaft (20). The collection head comprises a system of plates and spikes which collect and eject collected debris. This system of plates and spikes further comprises a backing plate (40), a spike plate (50), an ejection plate (60), a plurality of spikes (70), a pair of shoulder bolts (80), and a pair of attachment screws (23). In the preferred embodiment, the spikes (70) are comparable to sharpened eight penny nails with round heads.

The backing plate (40), the spike plate (50), and the ejection plate (60) are generally rectangular and have the same length and width though the thickness can vary. In the preferred embodiment, these parts are metal though the invention is not limited to metal as the plates may also be made of polymers or other composite materials.

The spike plate (50) holds the spikes (70) and the backing plate (40) secures the spikes (70) in place. The spike plate (70) has counter sunk holes (54) through which the spikes (70) rest with the tops of the spike heads being flush with the top surface of the spike plate (50). The spike plate (50) has a pair of threaded holes (53) that are aligned with a pair of slightly larger holes of the backing plate (43). A pair of threaded attachment screws (23) passes through a pair of holes (43) in the attachment plate (24) of the shaft and through the pair of holes (43) of the backing plate (40) to mesh with the threaded holes (53) of the spike plate (50). As these attachment screws (23) are tightened, the backing plate (40) and the spike plant (50) of the collection head are removably attached to the shaft (20). Also, as these attachment screws (23) are tightened, the backing plate (40) locks against the spike plate (50) firmly fixing the spikes (70) in place.

When in the course of debris collection it becomes necessary to replace a damaged spike, the human operator need only temporarily remove the attachment screws (23), separate the backing plate (40) from the spike plate (50), and exchange the damaged spike with a new spike. The human operator would then reattach the backing plate (40) and spike plate (50) and reset the attachment screws (23).

Both the backing plate (40) and the spike plate (50) each have three more aligning holes. One of these holes (42 and 52, respectively) is disposed in the center of the respective plates. This central hole allows the pusher rod (30) of the trigger system to pass from the shaft (20) through backer plate (40) and the spike plate (50) unobstructed to the ejection plate (60).

The other pair of holes (41 and 51, respectively) referenced above, which pass through the backing plate and the spike plate, facilitate the shoulder bolts (80) which are attached to the ejection plate (60). With respect to the backing plate (40), these holes (41) may be cylindrical holes or they may be slots cut into the backing plate (40) as shown in the drawings. Such holes (41) will be larger than the head of the shoulder bolts (80). With respect to the spike plate (50), they are a pair of holes (51) sized just larger than the shaft of the shoulder bolts (80) but smaller than the head of the shoulder bolts (80).

The shoulder bolts (80) are a pair of bolts with outward threading at the lower end, a large head at the upper end, and a smooth, level cylindrical surface or shaft between the lower and upper ends. The lower threaded end of the shoulder bolts (80) are removably attached via threaded connection to the ejection plate (60).

The ejection plate (60) is used to eject the debris from the collection head and to serve as a safety mechanism when the device is not being used. It operates from a loaded position (see FIG. 3) with the spikes (70) exposed to an ejected position (see FIG. 4) with the spikes (70) shielded. The pusher rod (30) which extends through the shaft (20), through the backer plate (40), and through the spike plate (50), terminates at and is fixedly attached to the ejection plate (60) at connection point (62). The ejection plate (60) has a plurality of holes (63) which are aligned with the spikes (70) such that when the spikes pass through the ejection plate (60), the spikes (70) will be parallel. When the device is in the loaded position (see FIG. 3), the ejection plate (60) will be in close proximity to the spike plate (50) with the spikes (70) being exposed through the holes (63) in the ejection plate (60). Moreover, when the device is in the loaded position (see FIG. 3), the head of the shoulder bolts (80) will be elevated above the level of the backing plate (40). When the device is in the ejected position (see FIG. 4), the ejection plate (60) will be further from the spike plate (50) such that the sharpened tips of the spikes (70) are just inside the holes (63) of the ejection plate (60). Moreover, when the device is in the ejected position (see FIG. 4), the head of the shoulder bolts (80) will be resting on the top surface of the spike plate (50).

We claim:

1. A debris collection device comprising: a handle, a shaft fixedly attached to said handle, a trigger ejection system utilizing a compression spring slidingly attached to and internal to said shaft, and a collection head fixedly attached to said shaft and to said trigger ejection system, wherein said trigger ejection system and said collection head operate from a loaded position where the compression spring is tightly compressed to an ejected position where some of the spring force of the compression spring has been released such that any debris that may have been collected on the collection head while in the loaded position is accordingly released when actuated into the ejected position and, wherein said handle is ergonomically curved with respect to said shaft such that it comprises a power grip.

2. The debris collection device of claim 1 wherein said shaft is cylindrical and hollow and further comprises an attachment plate, having a pair of attachment holes disposed thereon, for attachment to the collection head, a trigger slot in the shape of an inverted fish hook comprising a lower tail end and a hook end, and an indention point just below the lower tail end of the trigger slot; and wherein said trigger ejection system further comprises a trigger handle, a trigger actuator, a pusher rod, a spring pusher, and a spring stop, said pusher rod being housed inside said shaft and fixedly attached to an ejection plate portion of said collection head, said trigger actuator fixedly attached to said pusher rod, said trigger handle fixedly attached to said trigger actuator, said spring stop fixedly attached to said pusher rod, said spring pusher slidingly attached to said pusher rod and movable within the portion of said shaft below the indention point, said compression spring slidingly attached to said pusher rod and located between said spring pusher and said spring stop, said trigger handle extending through said trigger slot such that said trigger handle is located in the hook end of said trigger slot when in the loaded position and in the lower tail end of said trigger slot when in the ejected position.

3. The debris collection device of claim 2 wherein said collection head further comprises a backing plate, a spike plate, an ejection plate, a plurality of spikes, and a plurality of shoulder bolts; each of said spikes having a cylindrical shape and comprising a shaft portion and a pair of opposed ends having a rounded head at one end and a sharpened point at the other end wherein the circumference of the rounded head is larger than the circumference of the shaft portion of said spike; said backing plate having a central hole through which the pusher rod of the trigger ejection system passes, a pair of attachment holes through which a pair of attachment screws, having passed through the attachment holes of the attachment plate of the shaft, pass, and a pair of slots through which the shoulder bolts pass; said spike plate having a central hole through which the pusher rod of the trigger ejection system passes, a plurality of counter sunk holes, a pair of threaded holes which mesh with the attachment screws, and a pair of shoulder bolt holes through which the shoulder bolts pass, each of said counter sunk holes having a large diameter sized slightly larger than the diameter of the rounded head of the spike and a small diameter sized slightly larger than the diameter of the shaft of the spike, and each of said counter sunk holes having a depth sized so that when the spike is inserted, the top portion of said rounded head of said spike is flush with the top surface of said spike plate; said ejection plate having a plurality of ejection holes through which the spikes pass when the device is operated from the loaded position to the ejection position, a plurality of threaded shoulder bolt holes which mesh with a threaded portion of the shoulder bolts, and a central hole for fixed attachment to the pusher rod of said trigger ejection system.

4. The debris collection device of claim 3 further comprising a trigger slot guard, said trigger guard having a cylindrical shape with a diameter slightly larger than the exterior diameter of said shaft, having a height twice as large as the length of said trigger slot, and having centrally disposed a hole slightly larger than the trigger handle of said trigger ejection system such that the trigger handle of said trigger ejection system passes through said hole and such that the trigger slot guard moves with the trigger handle when trigger handle is released from the hook end of said trigger slot and moves, via the released spring force of said compression spring, to the lower tail end of the trigger slot.

* * * * *